United States Patent [19]

Williams et al.

[11] Patent Number: 4,688,303

[45] Date of Patent: Aug. 25, 1987

[54] RIFLE AND BOW HUNTERS BUCKLE

[76] Inventors: Larry B. Williams, Rte. 1, Box 202 A, Supply, N.C. 28462; George Spector, 233 Broadway, Rm 3615, New York, N.Y. 10007

[21] Appl. No.: 870,498

[22] Filed: Jun. 4, 1986

[51] Int. Cl.[4] ..... A44B 11/00

[52] U.S. Cl. ..... 24/163 K; 224/163

[58] Field of Search ..... 24/163 K, 163 R, 3 R, 24/3 F; 224/163, 243, 249, 912; 40/21 C; D2/406; 22/104

[56] References Cited

U.S. PATENT DOCUMENTS

| | | | |
|---|---|---|---|
| 982,476 | 1/1911 | Cater | 24/3 F |
| 1,429,641 | 9/1922 | Sayko | 24/163 K |
| 2,306,365 | 12/1942 | Stair | 224/249 |
| 3,969,836 | 7/1976 | Dubois | 24/163 K |
| 4,031,859 | 6/1977 | Stewart | 40/21 C |
| 4,052,773 | 10/1977 | Nesbitt | 24/163 K |
| 4,053,966 | 10/1977 | Dieleman | 24/163 K |
| 4,389,775 | 6/1983 | Collins | 24/163 K |
| 4,450,992 | 5/1984 | Casull | 224/163 |
| 4,498,612 | 2/1985 | Geekie, Jr. | 224/163 |

*Primary Examiner*—Victor N. Sakran

[57] ABSTRACT

A decorative belt buckle is provided and consists of an arrowhead shaped base plate which is adapted for mounting an empty rifle cartridge thereto, wherein the rifle cartridge is at least part of the ornamentation for the buckle.

2 Claims, 5 Drawing Figures

RIFLE AND BOW HUNTERS BUCKLE

BACKGROUND OF THE INVENTION

The instant invention relates generally to belt buckles and more specifically it relates to a belt buckle in the shape of an arrowhead which is adapted for mounting a rifle cartridge thereto, wherein the rifle cartridge is at least part of the ornamentation for the buckle.

Numerous belt buckles have been provided in prior art that are adapted to hold various objects, such as watches, knifes and small handguns. For example, U.S. Pat. Nos. 4,053,966; 4,389,775 and 4,450,992 all are illustrative of such prior art. While these units may be suitable for the particular purpose to which they address, they would not be as suitable for the purposes of the present invention as heretofore described.

SUMMARY OF THE INVENTION

A principle object of the present invention is to provide a belt buckle in the shape of an arrowhead which is adapted to have a rifle cartridge mounted thereon.

Another object is to provide a belt buckle in which one entire side of the rifle cartridge is visible from the front of the buckle when the rifle cartridge is mounted on the buckle.

An additional object is to provide a belt buckle wherein the rifle cartridge is releasably mounted to the buckle so that the rifle cartridge can be replaced when needed.

A further object is to provide a belt buckle that is economical in cost to manufacture.

A still further object is to provide a belt buckle that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
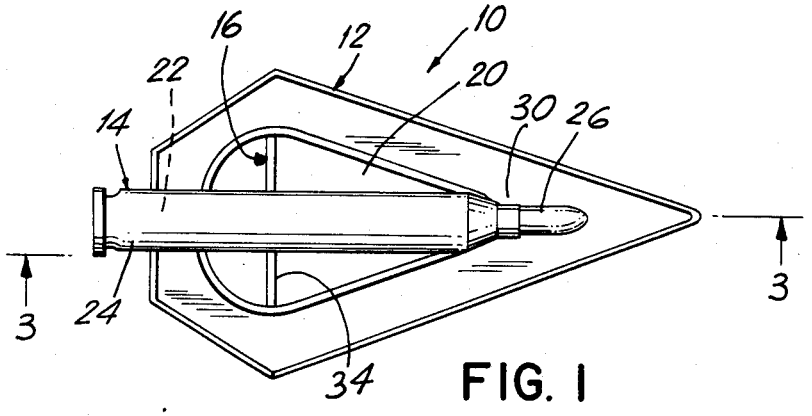
FIG. 1 is a front view of the invention.
Figure 2:
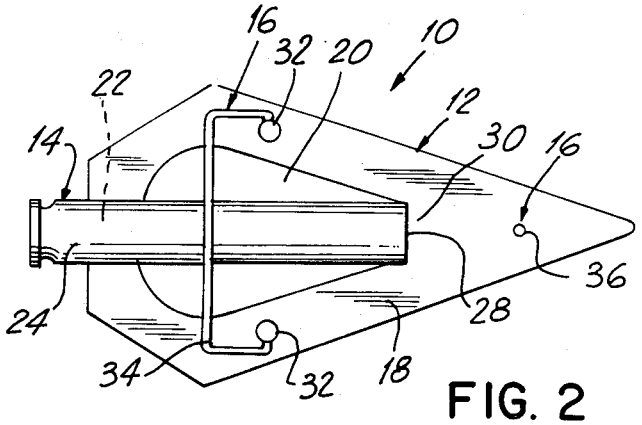
FIG. 2 is a rear view thereof.
Figure 3:
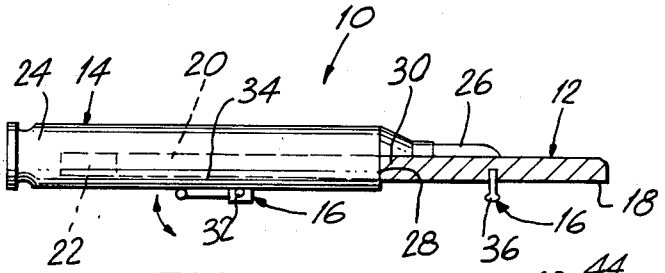
FIG. 3 is a cross sectional view taken along line 3—3 in FIG. 1 showing the cut away portion of the rifle cartridge.

Turning now descriptively to the drawings, in which similar reference characters denote similar elements throughout the several views, FIGS. 1 through 3 illustrates a decorative belt buckle 10 which contains an arrowhead shaped base plate 12, a rifle cartridge 14 and structure 16 on the back 18 of the base plate for receiving and attaching ends of a belt (not shown).

The arrowhead shaped base plate 12 has an aperture 20 with a rearwardly extending opening 22 therein. The rifle cartridge 14 includes an empty case 24 and bullet 26 with front portion of the case and bullet cut away to form a notch 28. The rifle cartridge 14 is mounted on the base plate 12 by welding or the like, with the case 24 placed through the opening 22 and into the aperture 20 so that the notch 28 will make contact with the base plate at 30.

The structure 16 includes a pair of fasteners 32, 32, a belt loop 34 and a hook 36. The fasteners 32, 32 are spaceably mounted to back surface 18 of the base plate 12. The belt loop 34 is attached to the fasteners so that one end of the belt can be fastened to the loop 34 in a suitable manner. The hook 36 is mounted to the back surface 18 of the base plate 12 to be inserted through belt openings in other end of the belt to buckle the belt.

Figure 4:
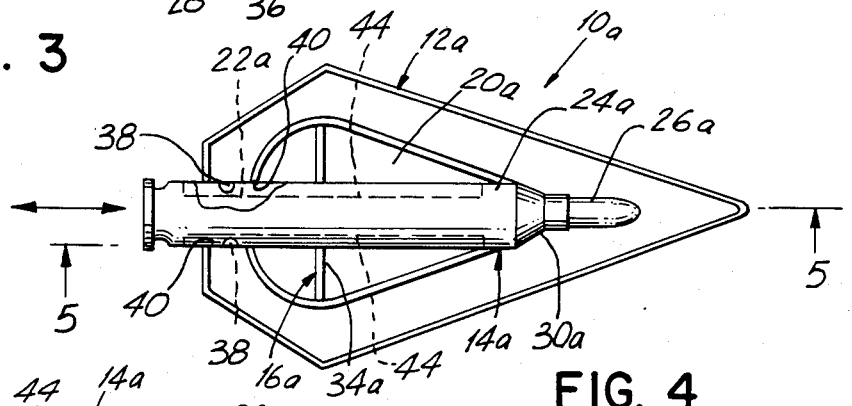
FIG. 4 is a front view with parts broken away of a modified buckle whereby the rifle cartridge slides in and out so that it can be replaced when needed.
Figure 5:
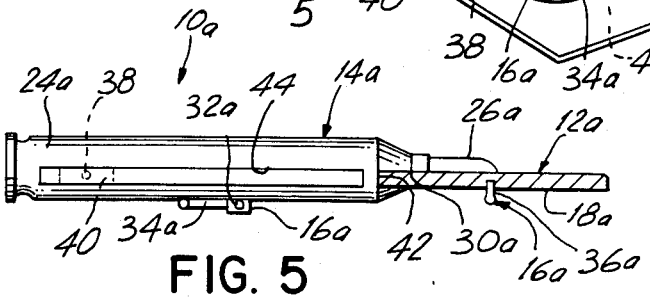
FIG. 5 is a cross sectional view taken along line 5—5 in FIG. 4 showing the slot and cut out portion in the rifle cartridge.

FIGS. 4 and 5 shows a modified decorative belt buckle **10*a*. The arrowhead shaped base plate 12*a* has an aperture 20*a* with a rearwardly extending opening 22*a* therein and a pair of pins 38, 38. Each pin 38 is formed on one side 40 of the opening 22*a*** so that the pins will extend inwardly within the opening.

The rifle cartridge **14*a* is an empty case 24*a* and bullet 26*a*. The front portion of the case and the bullet has an undercut 42 and the case 24*a* has a pair of elongated slots 44, 44 formed on opposite sides. The rifle cartridge 14*a* is removably mounted on the base plate 12*a* with the case 24*a* placed through the opening 22*a* and into the aperture 20*a* so that the pins 38, 38 will engage the slots 44, 44. The undercut 42 will make contact with the base plate 12*a* at 30*a* allowing the rifle cartridge 14*a*** to slide in and out, and be replaced when needed.

The structure **16*a* on the back 18*a* of the base plate 12*a* is for receiving and attaching ends of a belt and is the same as structure 16. Structure 16*a* includes a pair of fasteners 32*a*, 32*a*, a belt loop 34*a* and a hook 36*a*. The fasteners 32*a*, 32*a* are spaceably mounted to back surface 18*a* of the base plate 12*a*. The belt loop 34*a*, is attached to the fasteners so that one end of the belt can be fastened to the loop 34*a* in a suitable manner. The hook 36*a* is mounted to the back surface 18*a* of the base plate 12*a*** to be inserted through belt openings in other end of the belt to buckle the belt.

The belt buckles 10 and **10*a* are designed for both the rifle hunter and bow hunter and especially for the rifle and bow hunter. The base plates 12 and 12 are made out of polished stainless steel (silver in color) and beveled at the outside and inside edges. They are flat and can have a slight lengthwise curve to prevent the ends from extending outwardly from the belt. The rifle cartridges 14 and 14*a*** are both thirty calibre in size and are polished brass.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A decorative belt buckle which comprises:

(a) an arrowhead shaped base plate having an aperture with a rearwardly extending opening therein and a pair of pins, each of which is formed on one side of said opening so that said pins extend inwardly within said opening;

(b) a rifle cartridge being an empty case and bullet with front portion of said case and said bullet having an undercut and said case having a pair of elongated slots formed on opposite sides, said rifle cartridge removably mounted on said base plate with said case placed through said opening and into said aperture so that said pins will engage said slots and said undercut will make contact with said base plate allowing said rifle cartridge to slide in and out and be replaced when needed; and (c) means formed on back of said base plate for receiving and attaching ends of a belt.

2. A decorative belt buckle as recited in claim 1, wherein said receiving and attaching means includes:

(a) a pair of fasteners spaceably mounted to back surface of said base plate;

(b) a belt loop attached to said fasteners so that one end of said belt can be fastened to said loop in a suitable manner; and (c) a hook mounted to said back surface of said base plate to be inserted through belt opening in other end of said belt to buckle said belt.

* * * * *